US011009303B2

(12) United States Patent
Hudson, III

(10) Patent No.: US 11,009,303 B2
(45) Date of Patent: May 18, 2021

(54) FIREARM BARREL ASSEMBLY

(71) Applicant: Daniel Defense LLC, Black Creek, GA (US)

(72) Inventor: Billie Cyril Hudson, III, Georgetown, TX (US)

(73) Assignee: DANIEL DEFENSE, LLC, Black Creek, GA (US)

( * ) Notice: Subject to any disclaimer, the term of this patent is extended or adjusted under 35 U.S.C. 154(b) by 0 days.

(21) Appl. No.: 15/644,573

(22) Filed: Jul. 7, 2017

(65) Prior Publication Data

US 2017/0314881 A1 Nov. 2, 2017

Related U.S. Application Data

(63) Continuation-in-part of application No. 14/732,644, filed on Jun. 5, 2015, now Pat. No. 9,915,485.

(60) Provisional application No. 62/013,090, filed on Jun. 17, 2014.

(51) Int. Cl.

| | |
|---|---|
| ***F41A 5/04*** | (2006.01) |
| ***F41A 9/23*** | (2006.01) |
| ***F41A 9/24*** | (2006.01) |
| ***F41A 9/41*** | (2006.01) |
| ***F41A 9/55*** | (2006.01) |
| ***F41A 21/48*** | (2006.01) |
| ***F41C 3/00*** | (2006.01) |
| ***F41A 3/66*** | (2006.01) |
| *F41A 3/86* | (2006.01) |

(52) U.S. Cl.

CPC ..... *F41A 9/23* (2013.01); *F41A 3/66* (2013.01); *F41A 9/24* (2013.01); *F41A 9/41* (2013.01); *F41A 9/55* (2013.01); *F41A 21/48* (2013.01); *F41C 3/00* (2013.01); *F41A 3/86* (2013.01)

(58) Field of Classification Search

CPC ..... F41A 5/04; F41A 5/02; F41A 5/14; F41A 21/00

USPC ..... 89/163, 166, 167, 168

See application file for complete search history.

(56) References Cited

U.S. PATENT DOCUMENTS

| | | | | |
|---|---|---|---|---|
| 5,734,120 A * | 3/1998 | Besselink | F41A 3/14 | 89/163 |
| 5,815,973 A * | 10/1998 | Hochstrate | F41A 19/14 | 42/69.03 |
| 8,453,555 B1 * | 6/2013 | Karfiol | F41A 3/14 | 89/163 |
| 9,377,262 B2 * | 6/2016 | Curry | F41A 21/00 | |
| 2017/0314881 A1 * | 11/2017 | Hudson, III | F41A 3/66 | |

* cited by examiner

*Primary Examiner* — J. Woodrow Eldred

(74) *Attorney, Agent, or Firm* — Eversheds Sutherland (US) LLP

(57) ABSTRACT

The barrel of a pistol, specifically in a short recoil operated pistol, is comprised of multiple bearings surfaces comprised of cams and lugs that allow the pistol to function. The surfaces mechanically delay the pistol enough to allow the pistol to reliably function in the manner of an automatic firearm, chambering a round at the end of each cycle of operation. A barrel that locates a forward lug positioned horizontally in front of the trigger guard of the pistol with side cams that are shallow and interact in a way to provide the pistol with a robust and consistent lock up from shot to shot to provide an advantage in the function of the firearm.

1 Claim, 9 Drawing Sheets

FIREARM BARREL ASSEMBLY

CROSS-REFERENCE TO RELATED APPLICATIONS

The present application is related to and a continuation-in-part of, claims priority from and the benefit of co-pending U.S. patent application Ser. No. 14/732,644, filed Jun. 5, 2015, entitle SEMI-AUTOMATIC PISTOL, which in turn claims priority from U.S. provisional patent application 62/013,090 filed on Jun. 17, 2014, entitled "ANGLED SEAR RELEASE IN A SEMI-AUTOMATIC PISTOL," the disclosures of which applications are hereby incorporated by reference in their entirety for all that is taught and disclosed therein.

FIELD OF THE INVENTION

The present invention relates to firearms, and in particular to pistol barrels.

BACKGROUND

The barrel of a pistol, specifically in a short recoil operated pistol, is comprised of multiple bearings surfaces comprised of cams and lugs that allow the pistol to function. The surfaces mechanically delay the pistol enough to allow the pistol to reliably function in the manner of an automatic firearm, chambering a round at the end of each cycle of operation.

Pistol barrels, in short recoil operated pistols, have traditionally located their cam and lug surfaces as near to the bore of the pistol as possible. These surfaces are usually comprised of an easily machined single or double lug surface that locks into the frame of the pistol. This action, traditionally, happens above the trigger guard, which increases the bore axis of these traditional designs.

The traditional lock up system constricts the ability to lower the bore axis with a robust barrel design. The present invention provides a barrel that locates a forward lug positioned horizontally in front of the trigger guard of the pistol with side cams that are shallow and interact in a way to provide the pistol with a robust and consistent lock up from shot to shot.

SUMMARY

The barrel of the present invention provides a barrel with a forward lower lug surface operably forward of the bore and forward of the trigger guard that it operates in. It also has two side cams that interact with corresponding lugs in the pistol.

The placement of these cams and lugs, unique in pistol design, allow for the pistol to operate in as rugged and reliable a manner as other designs, while offering the advantages that the pistol design claims.

The present invention further contemplates a firearm barrel assembly having a trigger guard, an insert above the trigger guard, a barrel connected to the insert and defining a center line axis, a slide enclosing the barrel and operable to reciprocate along the center line axis between a forward battery position and a rearward open position, an arrangement of cams, lugs, and a pin, the arrangement connected to the barrel, such that the cams and lugs engage and disengage with each other and the pin as the barrel moves in and out of battery.

BRIEF DESCRIPTION OF THE DRAWINGS

For a more complete understanding of the present disclosure, and the advantages thereof, reference is now made to the following descriptions taken in conjunction with the accompanying drawings, in which.

DETAILED DESCRIPTION

The following discussion is directed to various embodiments of the invention. The term "invention" is not intended to refer to any particular embodiment or otherwise limit the scope of the disclosure. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

In the following discussion and in the claims, the terms "including" and "comprising" are used in an open-ended fashion, and thus should be interpreted to mean "including, but not limited to." Also, the term "connect" or "connected" or equivalent term where used if at all is intended to mean either an indirect or direct connection. Thus, if a first component connects to a second component, that connection may be through a direct connection or through an indirect connection via other components and connections.

Certain terms are used throughout the following description and claims to refer to particular system components and method steps. As one skilled in the art will appreciate, different companies may refer to a component by different names. This document does not intend to distinguish between components that differ in name but not function.

Figure 1A:
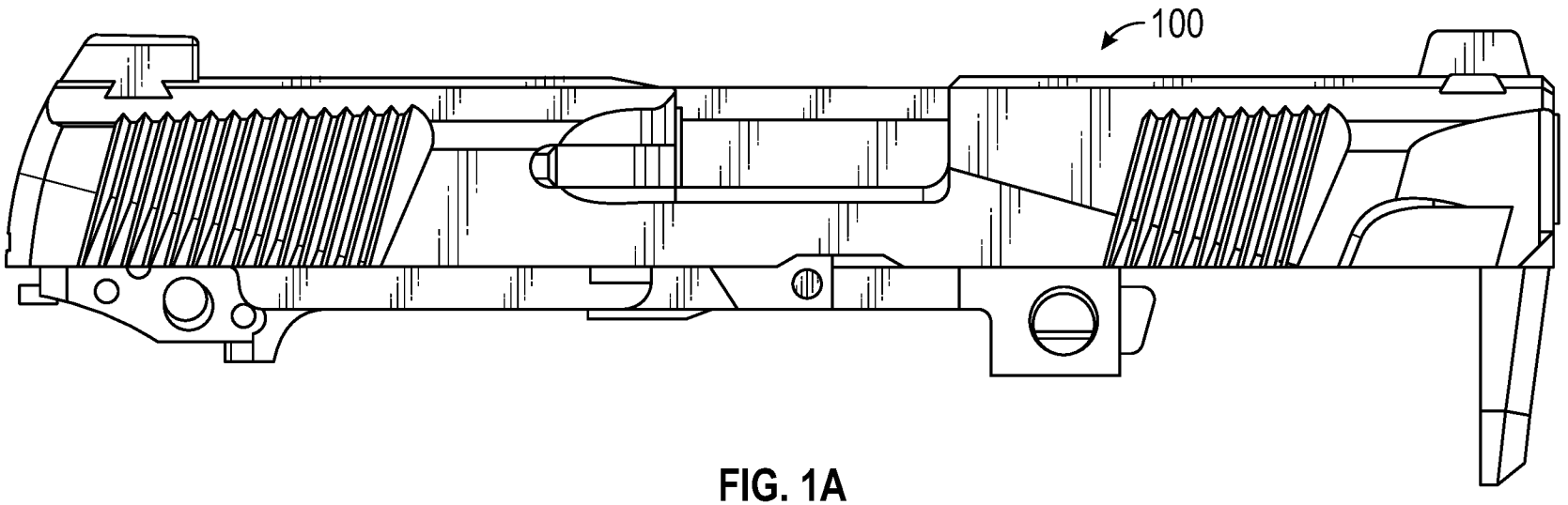
FIG. 1A is a side view of the barrel of the invention.

FIG. 1A is a side view of the barrel enclosed by a slide and operably mounted on a frame insert to provide a barrel assembly 100.

Figure 1B:
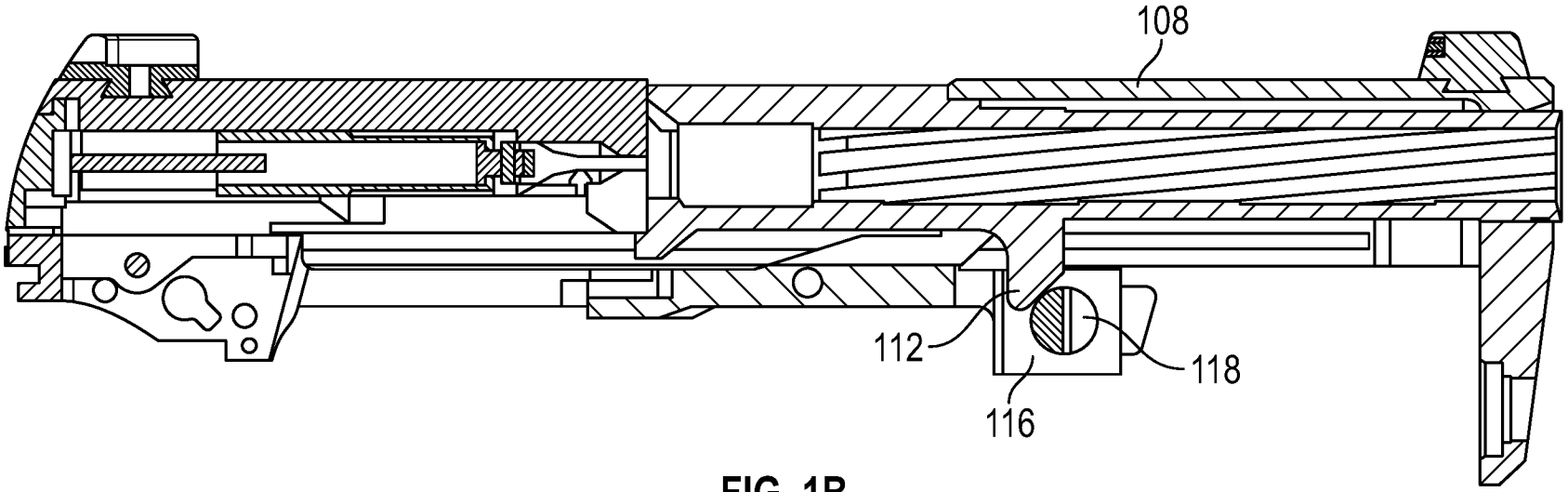
FIG. 1B is a cross-sectional view of FIG. 1A.

FIG. 1B is a cross-sectional view of FIG. 1A, showing the barrel front lug 112 resting on a pin 118 mounted into a frame insert 116 and operably retained by the slide 108 in assembly 100.

Figure 1C:
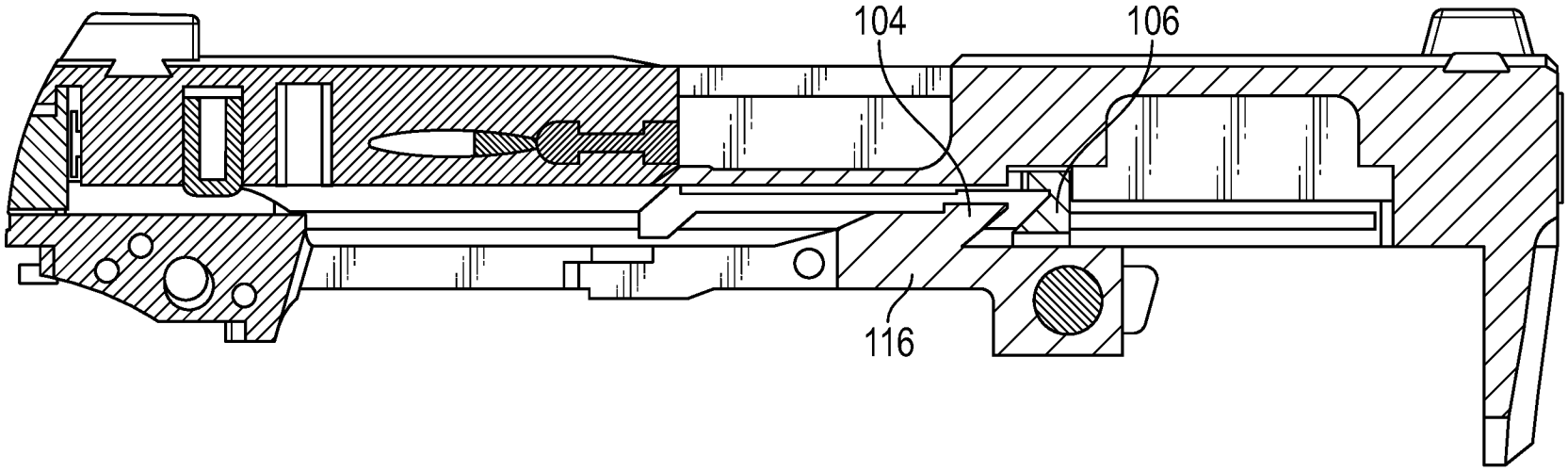
FIG. 1C is a cross-sectional view of FIG. 1C.

FIG. 1C is a cross-sectional view of FIG. 1C, showing the side cams 106 of the barrel 110 resting above corresponding lugs 104 in a frame insert 116.

Figure 2:
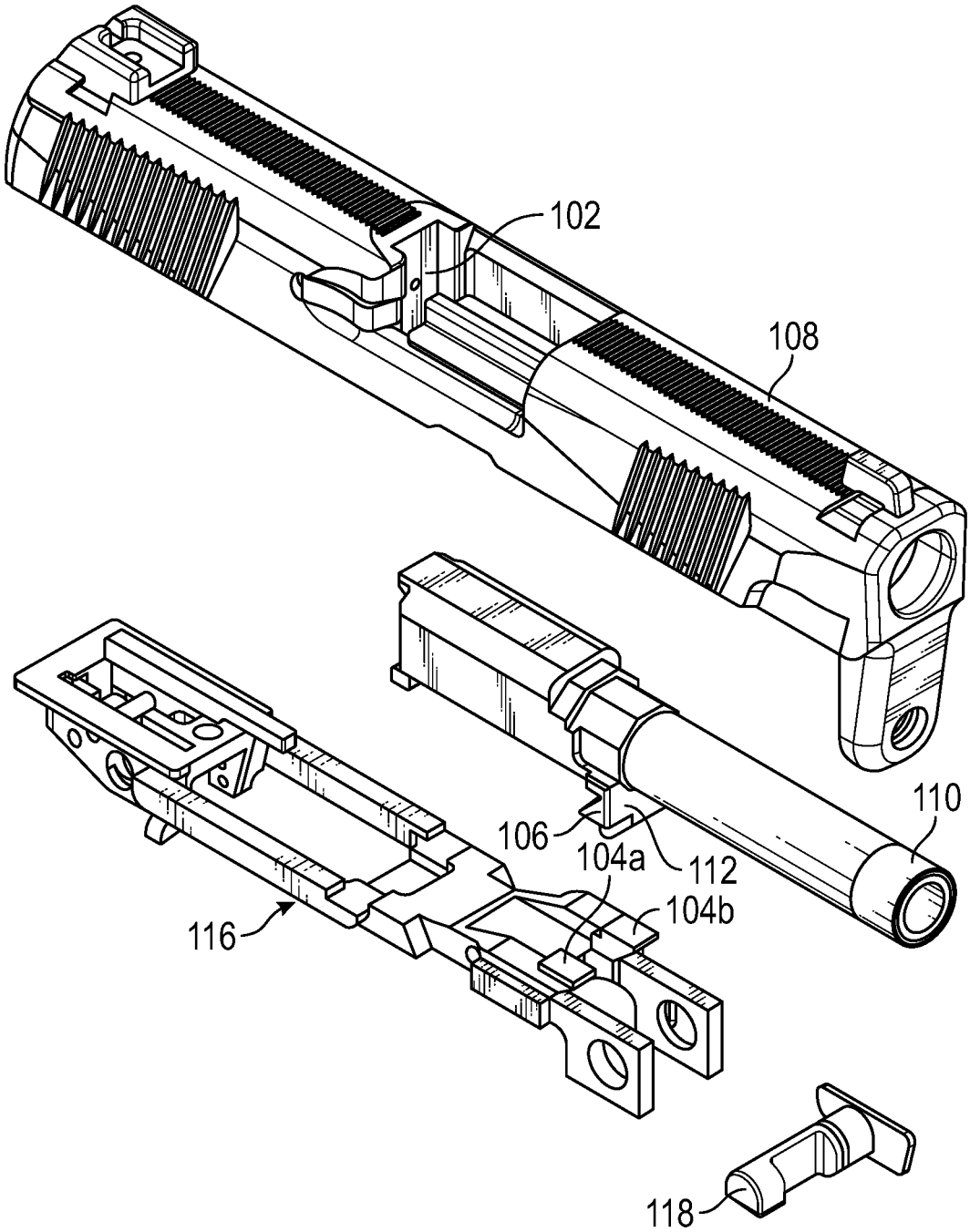
FIG. 2 is an exploded view of the barrel assembly of the invention.

FIG. 2 is an exploded view of the barrel 110, a slide 108 forward of breach face 102, a frame insert 116, and a pin 118. Lugs 106 are disposed behind barrel ramp 112 under barrel 110. Cams 104*a* and 104*b* (collectively, side cams 104) are mounted on insert 116, or alternatively are integral with insert 116.

Figure 3:
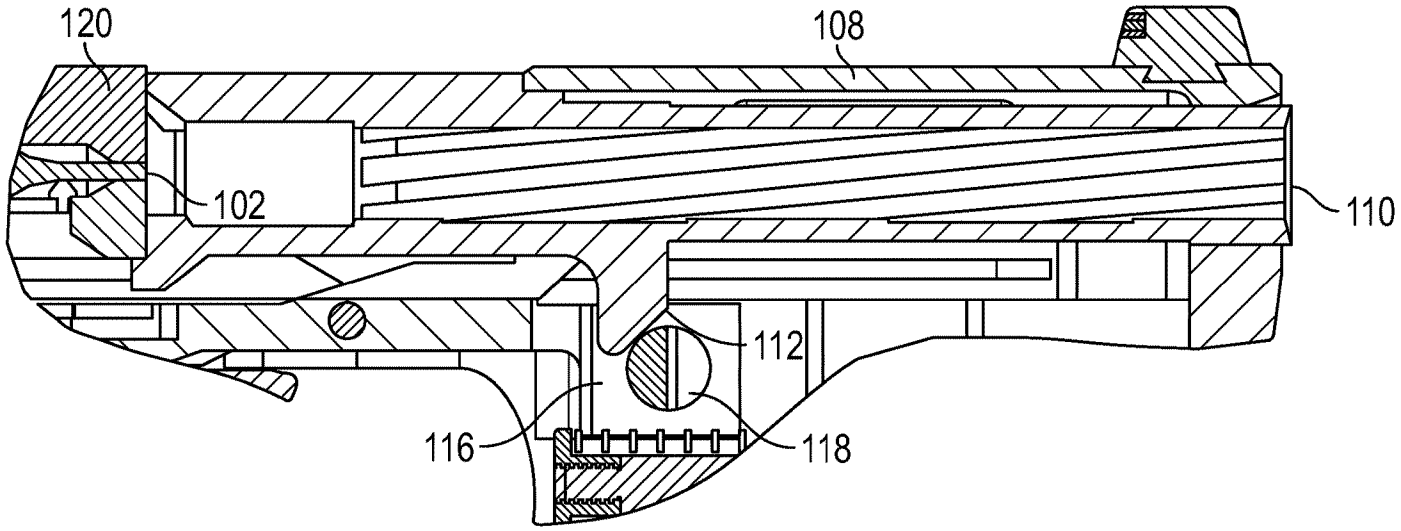
FIG. 3 is a cross-sectional view of the barrel in battery.

FIG. 3 is a cross-sectional view of the barrel 110 in battery, a slide 108 enclosing the barrel 110 and mounted to a frame insert 116 operably by the front lug 112 of the barrel 110 resting on a pin 118. Breach face 102 is forward of hood 120.

Figure 4:
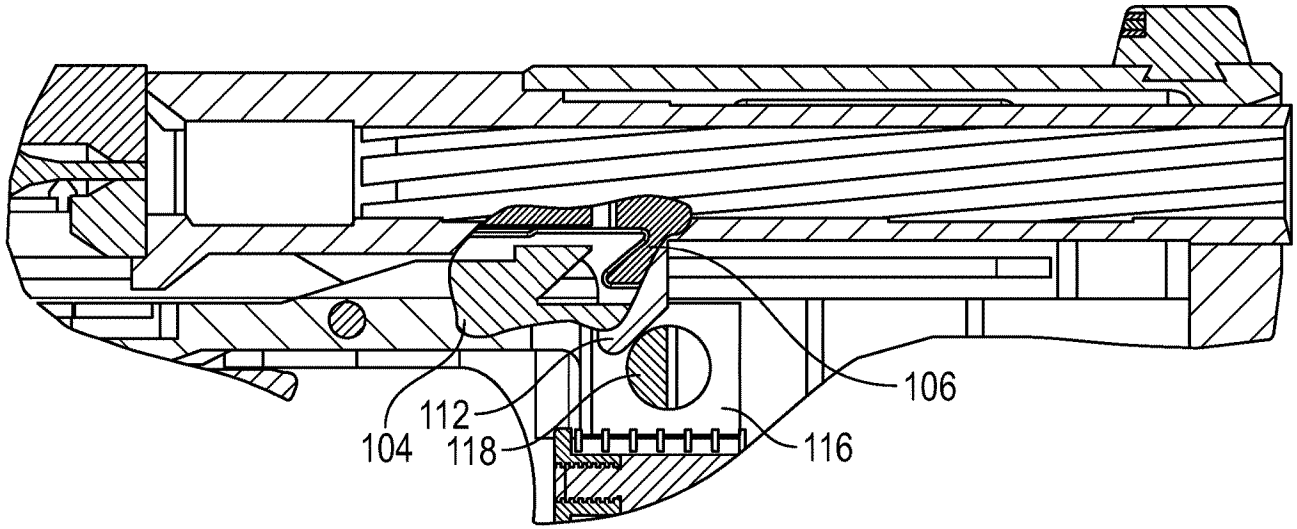
FIG. 4 is a cross-sectional view of the barrel of FIG. 3 with a cutaway detail.

FIG. 4 is the cross-sectional view of the barrel in battery of FIG. 3 with a cut away to reveal the cam and lug barrel mechanism. A slide 108 enclosing the barrel 110 and mounted to a frame insert 116 operably by the front lug 112 of the barrel 110 resting on a pin 118. A cutaway displays the side cams 106 of the barrel 110 in battery, not interacting with the corresponding lugs 104 on the insert 116.

Figure 5:
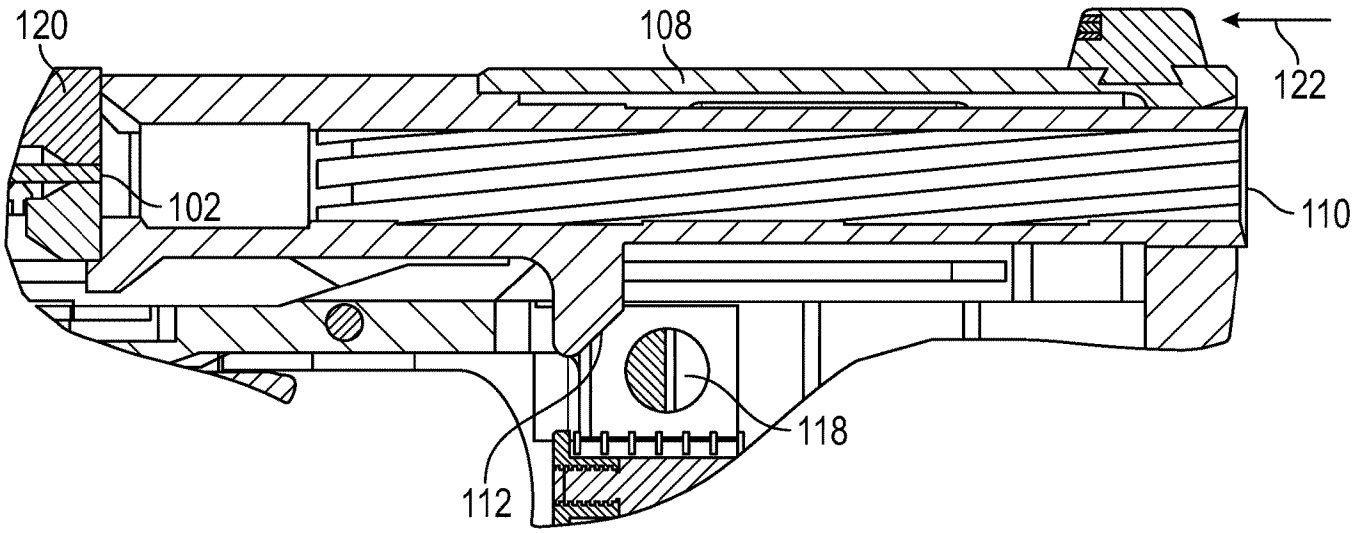
FIG. 5 is a cross-sectional view of the barrel disengaged from the front lug.

FIG. 5 is a cross-sectional view of the barrel disengaged from the front lug 112, a slide 108 enclosing the barrel 110 and moving rearward 122 causing the barrel 110 to disengage from a pin 118.

Figure 6:
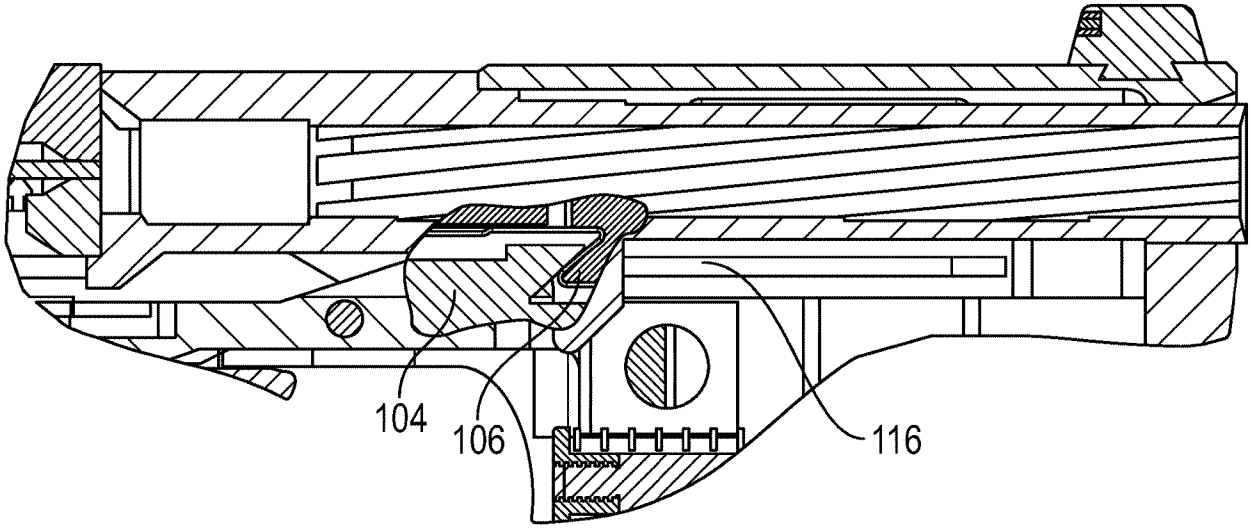
FIG. 6 is a cross-sectional view of the barrel of FIG. 5 with a cutaway detail.

FIG. 6 is a cross-sectional view of the barrel out of battery, a slide 108 enclosing the barrel 110 and mounted to a frame insert 116 operably by the front lug 112 of the barrel 110 resting on a pin 118. A cutaway displays the side cams 106 of the barrel 110 in a rearward position, interacting with the corresponding lugs 104 on the insert 116.

Figure 7:
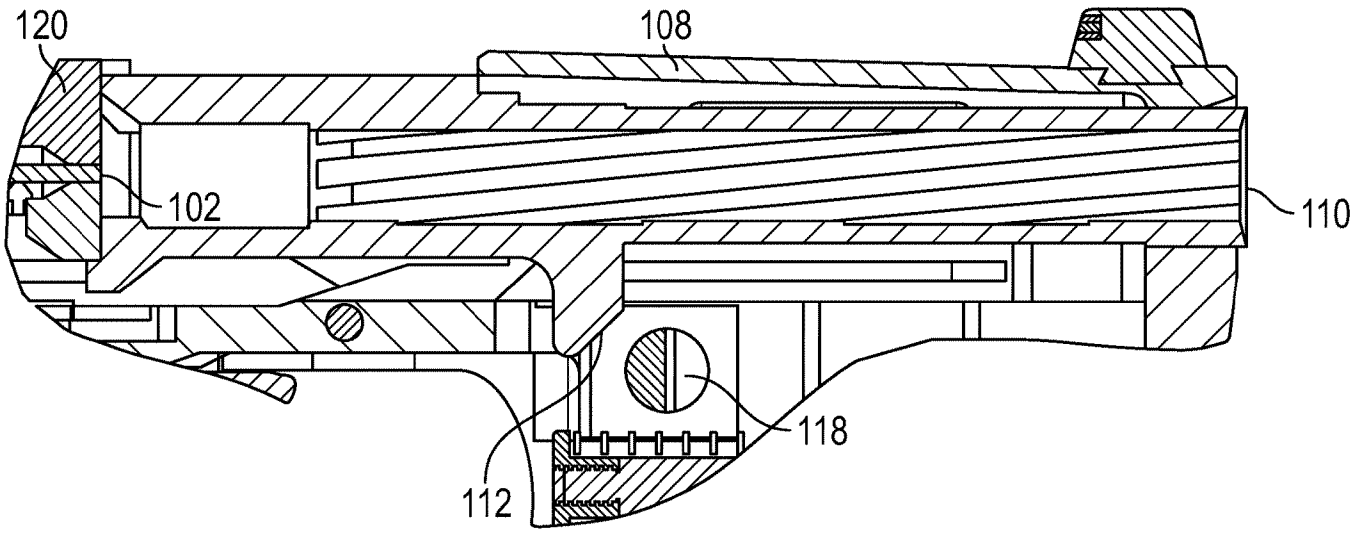
FIG. 7 is a cross-sectional view of the barrel at its most rearward point of travel.

FIG. 7 is a cross-sectional view of the barrel at its most rearward point of travel, a slide 108 enclosing the barrel 110 and moving further rearward than FIG. 5 causing the barrel hood 120 to drop below the surface of a slide 108.

Figure 8:
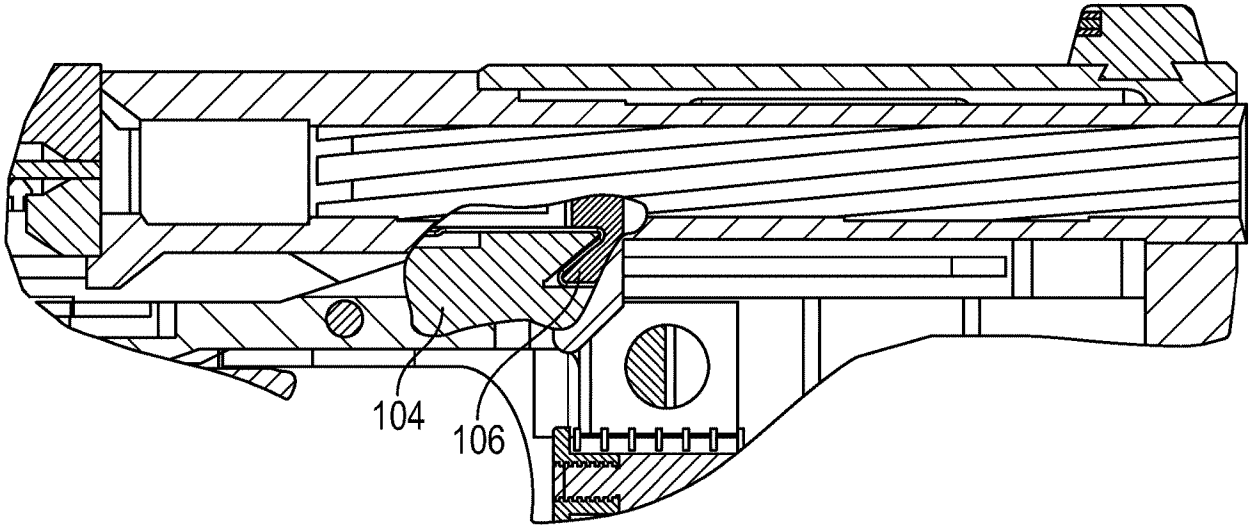
FIG. 8 is a cross-sectional view of the barrel of FIG. 7 with a cutaway detail.

FIG. 8 is a cross-sectional view of the barrel at its most rearward point of travel. A slide 108 enclosing the barrel 110 and mounted to a frame insert 116 operably by the front lug 112 of the barrel 110 resting on a pin 118. A cutaway displays the side cams 106 of the barrel 110 in the rearmost position, interacting with the corresponding lugs 104 on the insert 116.

Figure 9:
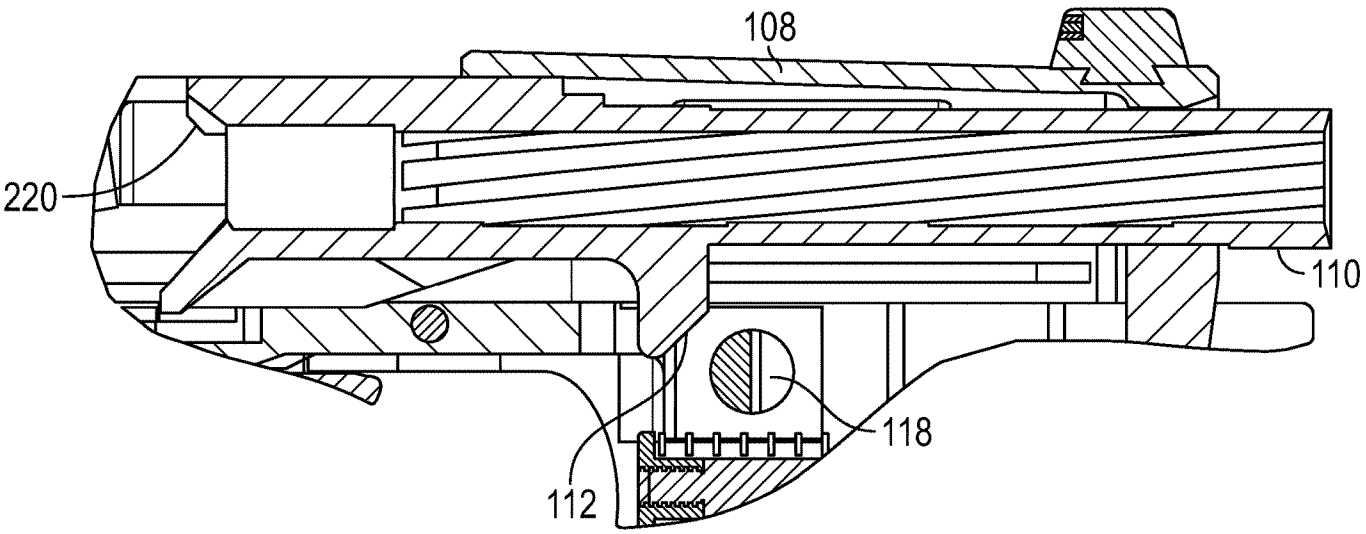
FIG. 9 is a cross-sectional view of the barrel at its most rearward point of travel.

FIG. 9 is a cross-sectional view of the barrel at its most rearward point of travel. a slide 108 enclosing the barrel 110 and moving further rearward than FIG. 7 causing the barrel hood 120 to drop below the surface of a slide 108.

Figure 10:
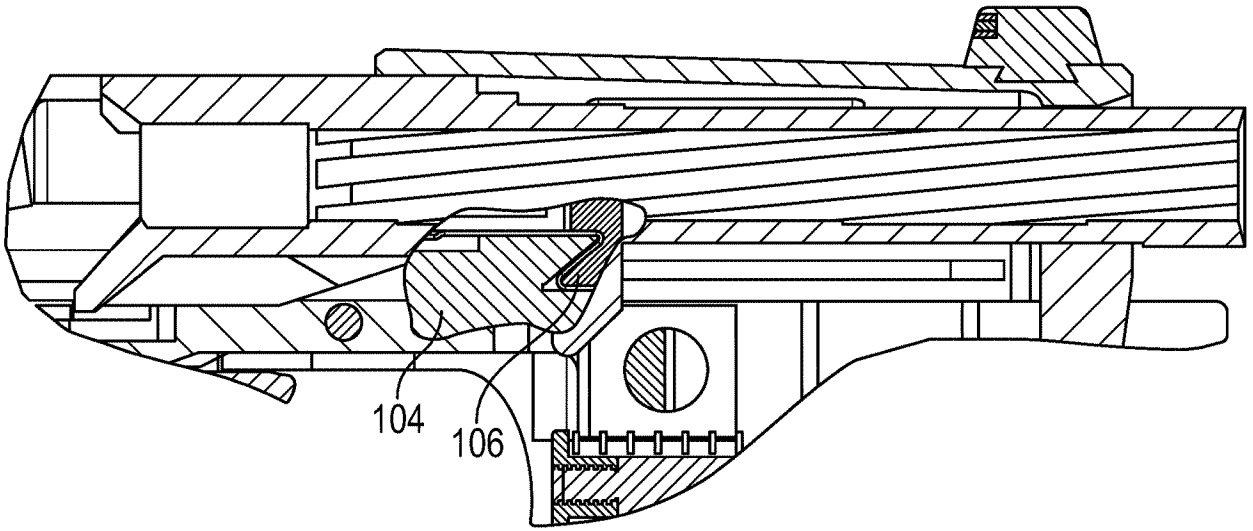
FIG. 10 is a cross-sectional view of the barrel of FIG. 9 with a cutaway detail.

FIG. 10 is a cross-sectional view of the barrel at its most rearward point of travel. A slide 108 enclosing the barrel 110 and mounted to a frame insert 116 operably by the front lug 112 of the barrel resting on a pin 118, a cutaway displays the side cams 106 of the barrel 110 in the rearmost position shown in FIG. 9, interacting with the corresponding lugs 104 on the insert 116.

Figure 11:
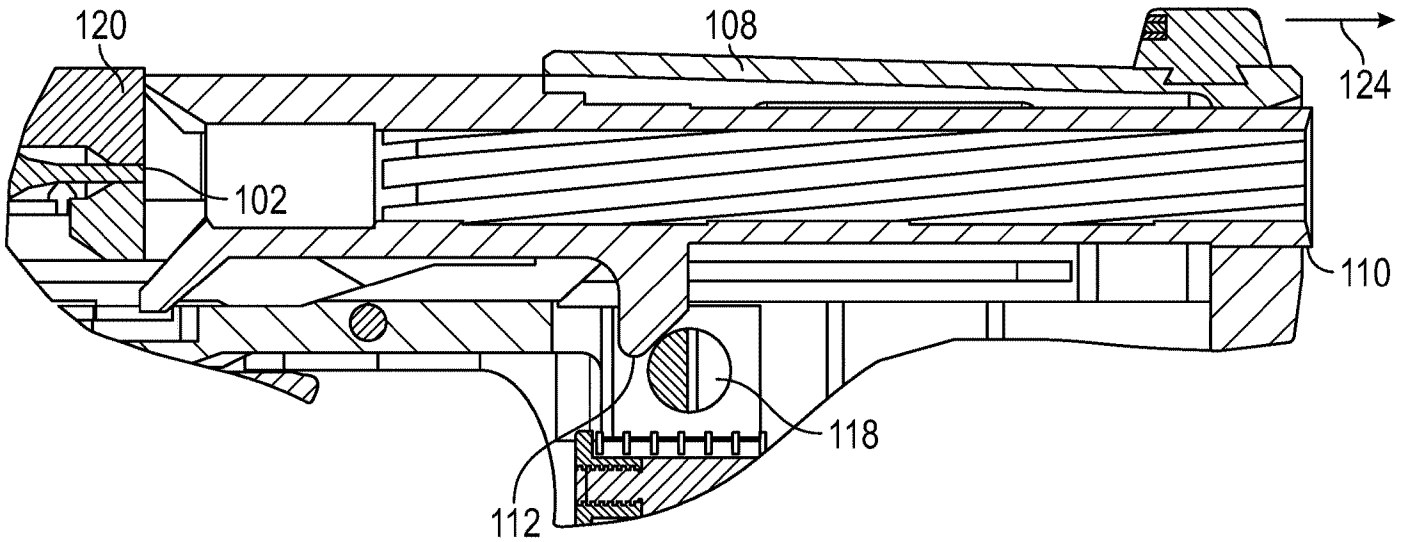
FIG. 11 is a cross-sectional view of the barrel at a point prior to return to battery.

FIG. 11 is a cross-sectional view of the barrel at a point prior to return to battery. Movement 124 is forward. A slide 108 enclosing the barrel 110 with the hood 120 not returning above the plane of the slide 108, the front lug 112 engaging a pin 118.

Figure 12:
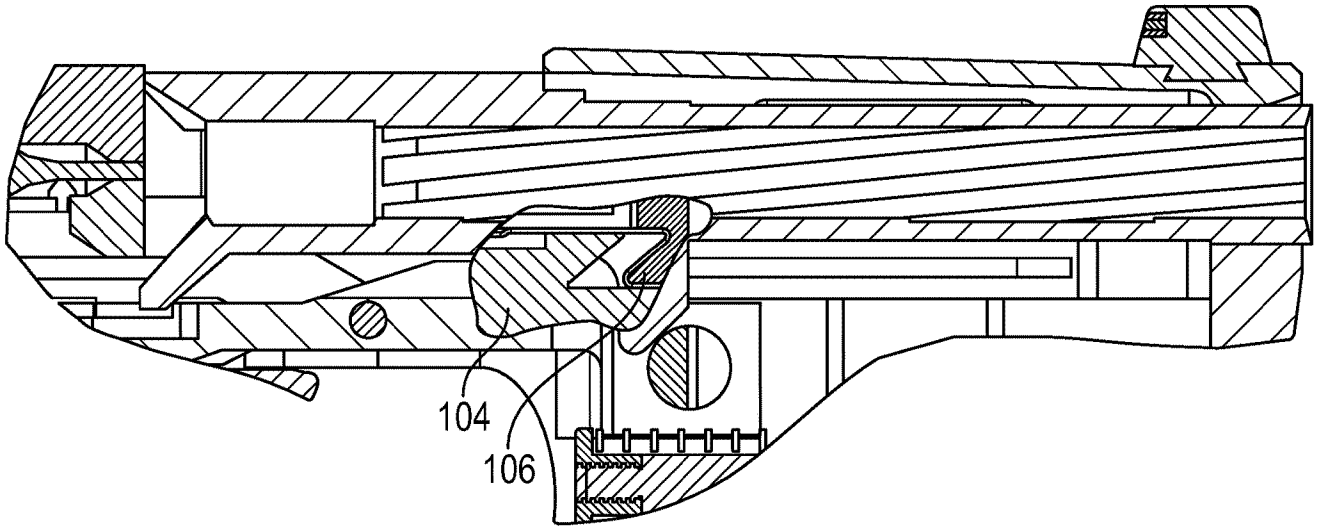
FIG. 12 is a cross-sectional view of the barrel of FIG. 11 with a cutaway detail.

FIG. 12 is a cross-sectional view of the barrel at a point prior to return to battery. A slide 108 enclosing the barrel 110 and returning the front lug 112 to rest on a pin 118 that mounts a frame insert 116, a cutaway displays the side cams 106 of the barrel 110 unlocking from the insert lugs 104.

Figure 13:
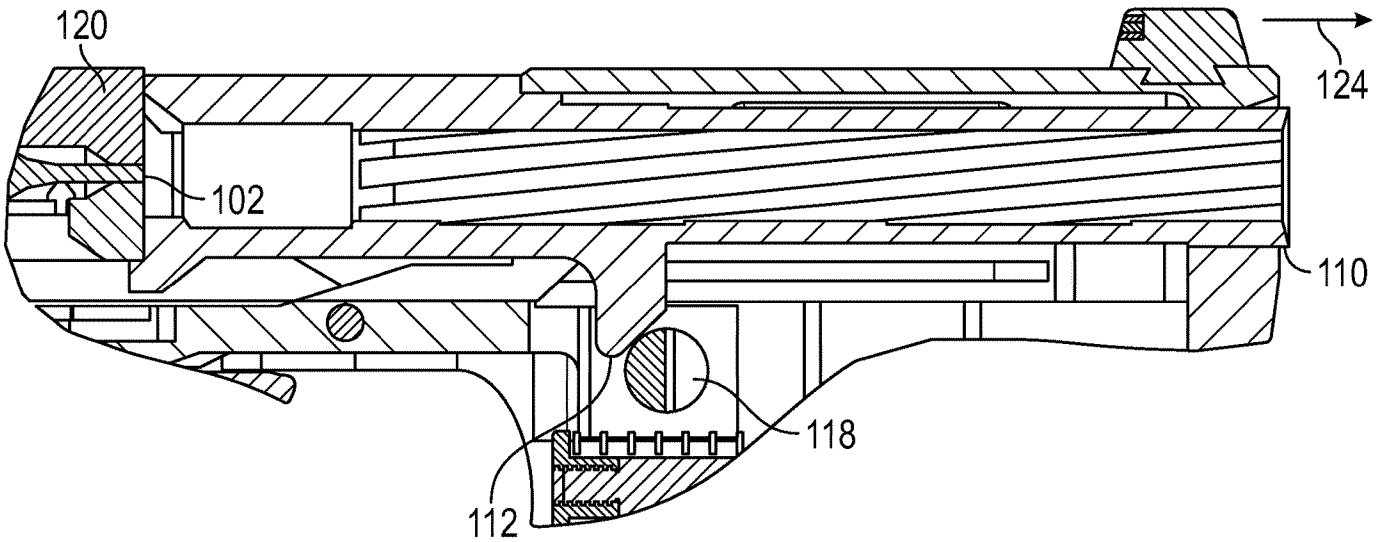
FIG. 13 is a cross-sectional view of the barrel returned to battery.

FIG. 13 is a cross-sectional view of the barrel returned to battery. A slide 108 enclosing the barrel 110, the front lug 112 engaging a pin 118 operably connected to a frame insert 116.

Figure 14:
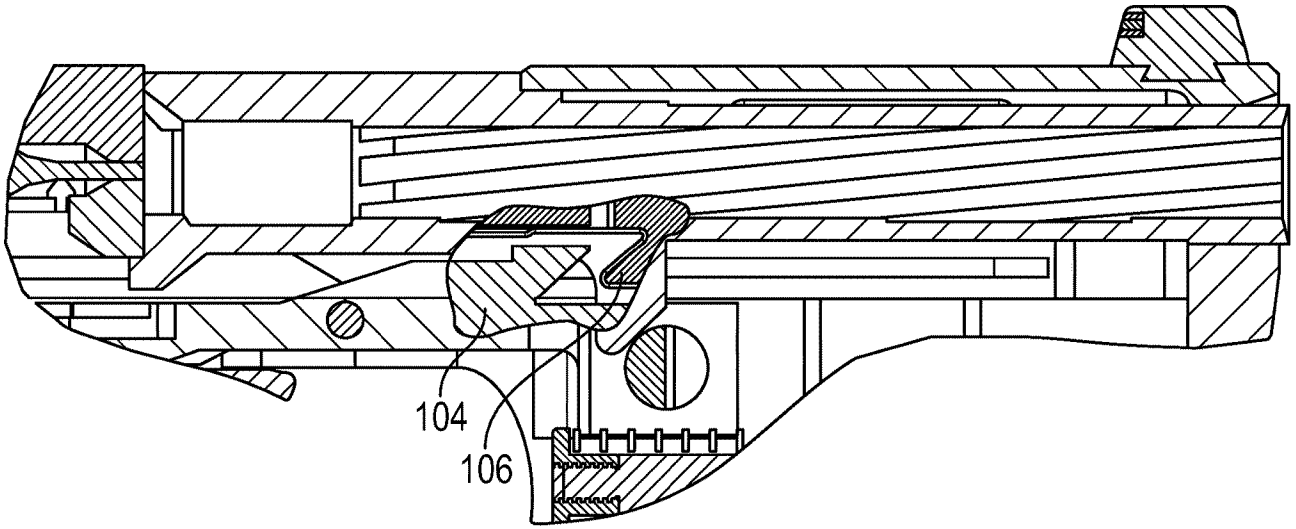
FIG. 14 is a cross-sectional view of the barrel of FIG. 13 with a cutaway detail.

FIG. 14 is a cross-sectional view of the barrel returned to battery. A slide 110 enclosing the barrel 110 and a front lug 112 resting on a pin 118 that mounts in a frame insert 116, a cutaway displays the side cams 106 of the barrel 110 resting in battery, disengaged from insert lugs 104.

Many modifications and other embodiments of the invention described herein will come to mind to one skilled in the art to which this disclosure pertains having the benefit of the teachings presented in the foregoing descriptions and the associated drawings. Therefore, it is to be understood that the disclosure is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A firearm, comprising:

a frame insert comprising (i) a pin and (ii) an insert lug, wherein the pin is disposed forward of the insert lug;

a barrel having (i) a breach face, (ii) a front lug, and (iii) a side cam, wherein the front lug is disposed forward of the side cam; and a slide configured to receive the frame insert and enclose the barrel, wherein, in a first configuration, (i) the front lug is configured to engage the pin to push the barrel upward and (ii) the insert lug and side cam are disengaged, wherein the barrel is in battery in the first configuration, wherein, in a second configuration, (i) the side cam is configured to engage the insert lug to pull the barrel downward and (ii) the front lug and the pin are disengaged, wherein the barrel is out of battery in the second configuration.

* * * * *